United States Patent [19]

Drapp

[11] Patent Number: 4,470,006

[45] Date of Patent: Sep. 4, 1984

[54] TRANSFORMER

[76] Inventor: Joseph W. Drapp, 7022 Eugene Ave., St. Louis, Mo. 63116

[21] Appl. No.: 428,888

[22] Filed: Sep. 30, 1982

[51] Int. Cl.[3] ..... G05F 3/06

[52] U.S. Cl. ..... 323/307; 323/338; 336/69; 336/212

[58] Field of Search ..... 323/248, 251–253, 323/306–307, 338; 336/69, 180–181, 155, 212

[56] References Cited

U.S. PATENT DOCUMENTS

| | | | |
|---|---|---|---|
| 2,870,397 | 1/1959 | Kelley, Jr. | 323/338 X |
| 3,395,373 | 7/1968 | Stephens | 336/212 X |
| 3,681,679 | 8/1972 | Chung | 323/307 X |
| 3,688,232 | 8/1972 | Szatmari | 336/69 |
| 4,007,416 | 2/1977 | Szatmari | 323/306 |
| 4,019,122 | 4/1977 | Ryan | 323/307 |

*Primary Examiner*—Peter S. Wong

*Attorney, Agent, or Firm*—Polster, Polster and Lucchesi

[57] ABSTRACT

A transformer with twelve cores, a first six arranged in parallel rows of three, a second six, in parallel rows of three at right angles to the first six and positioned between the first and second, and second and third cores of each row of the first six; four coil assemblies each comprising a primary winding and a secondary winding, each of the coil assemblies embracing legs of four cores, the primary and secondary coils being electrically connected in parallel to like coils in other coil assemblies in a 180° out of phase connection. Preferably, each coil assembly includes a capacitor coil, and the capacitor coils are series connected to one another at opposite corner poles so that each capacitor coil voltage is added to each other capacitor coil, the first and fourth of said capacitor coils being electrically connected to different sides of the line voltage, and the second and third of said capacitor coils being electrically connected in series to a capacitor.

2 Claims, 5 Drawing Figures

TRANSFORMER

BACKGROUND OF THE INVENTION

It is always desired to increase the efficiency of transformers, to decrease the heating and enable a smaller and lighter transformer to do the work of a larger and heavier one.

It is the object of this invention to provide a transformer that is more efficient than transformers known heretofore, in step-up, step-down or isolation modes.

SUMMARY OF THE INVENTION

In accordance with this invention, generally stated, a transformer is provided with twelve cores, a first six arranged in parallel rows of three, a second six, in parallel rows of three at right angles to the first six and positioned between the first and second, and second and third cores of each row of the first six, and four coil assemblies each comprising a primary winding and a seconardary winding, each of the coil assemblies embracing legs of four cores, the primary and secondary coils being electrically connected in parallel to like coils in other coil assemblies in a 180° out of phase connection. Preferably, each coil assembly includes a capacitor coil, and the capacitor coils are series connected to one another at opposite corner poles so that each capacitor coil voltage is added to each other capacitor coil, the first and fourth of said capacitor coils being electrically connected to different sides of the line voltage, and the second and third of said capacitor coils being electrically connected in series to a capacitor.

DESCRIPTION OF THE PREFERRED EMBODIMENT

Figure 1:
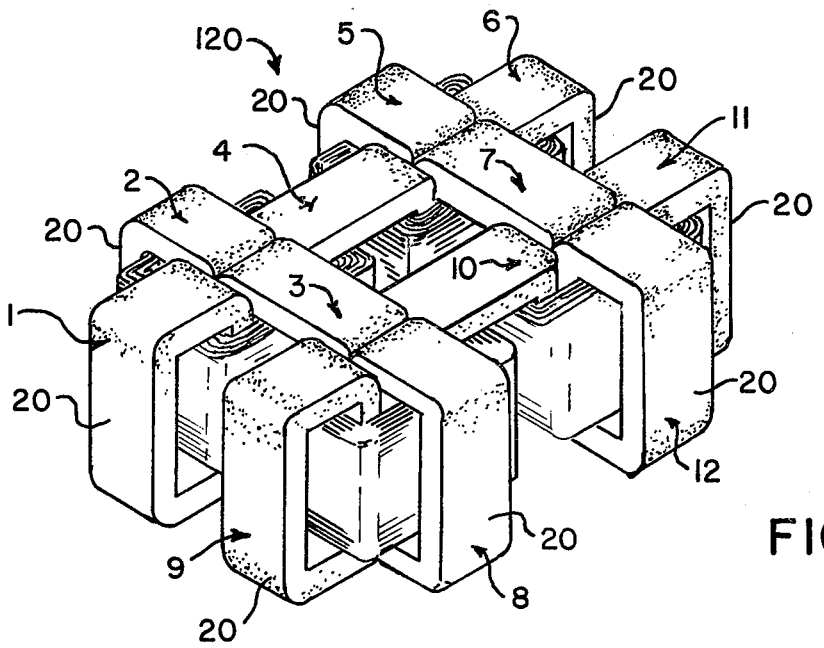
FIG. 1 is a view in perspective, with terminals removed for clarity, of one embodiment of transformer of this invention.
Figure 2:
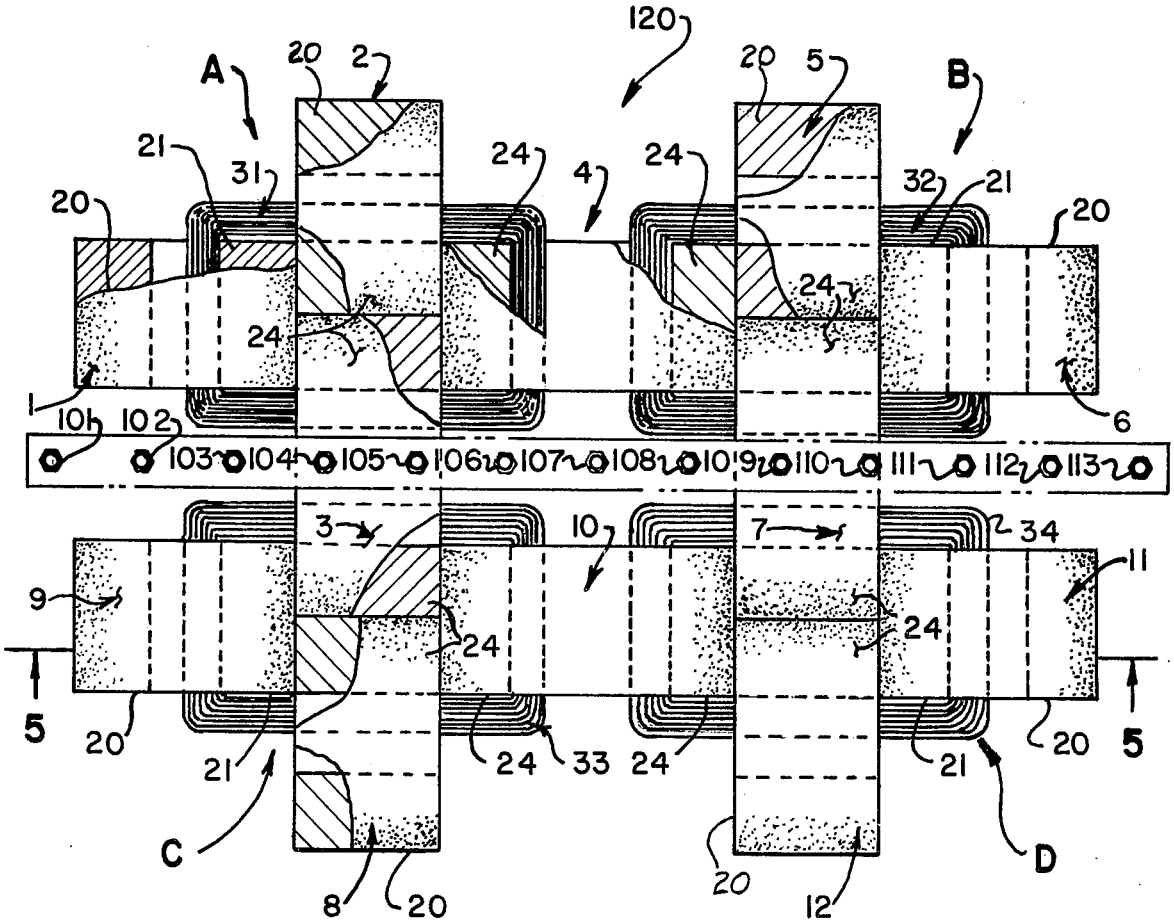
FIG. 2 is a top plan view, with terminals indicated.

Referring now to the drawing for one illustrative embodiment of transformer of this invention, reference numeral 120 indicates a transformer, which, in this embodiment includes four coil assemblies 31 (A), 32 (B), 33 (C), and 34 (D), all wound exactly the same and each consisting of a primary, secondary and capacitor coil. Each coil assembly is wound on four legs of cores arranged to present the legs in a rectangle. Four of the cores have outer legs 20 and inner legs 21; four have outer legs 20 and abutting legs 24, and four, abutting legs 24. There are twelve cores, core 1, core 2, core 3 and core 4 in the A sector, core 4 sharing with core 5, core 6, and core 7 in the B sector, core 3 charing with core 8, core 9 and core 10 in the C sector, and cores 7 and 10 sharing with cores 11 and 12 in the D sector. As viewed in FIG. 2, the A coil assembly is adjacent coil assemblies B and C, and diagonal from coil assembly D. Thus, each coil assembly is adjacent two other coil assemblies and diagonal from the fourth.

Primary coil 41, in the A coil assembly, has a start 45 and an end 46. Primary coil 42 in the B coil assembly, has a start 47 and an end 48. Primary coil 43, in the C coil assembly has a start 49 and an end 50. Primary coil 44, in the D coil assembly has a start 51 and an end 52.

Secondary coil 61, in the A coil assembly, has a start 65 and an end 66. Secondary coil 62 in the B coil assembly, has a start 67 and an end 68. Secondary coil 63, in the C coil assembly has a start 69 and an end 70. Secondary coil 64, in the D coil assembly has a start 71 and an end 72.

Capacitor coil 81, in the A coil assembly, has a start 85 and an end 86. Capacitor coil 82 in the B coil assembly, has a start 87 and an end 88. Capacitor coil 83, in the C coil assembly has a start 89 and an end 90. Capacitor coil 84, in the D coil assembly has a start 91 and an end 92.

In the embodiment shown, there are thirteen terminals, 101–113 inclusive. There are line inputs 96 and 97, and transformer outputs 98 and 99.

Figure 3:
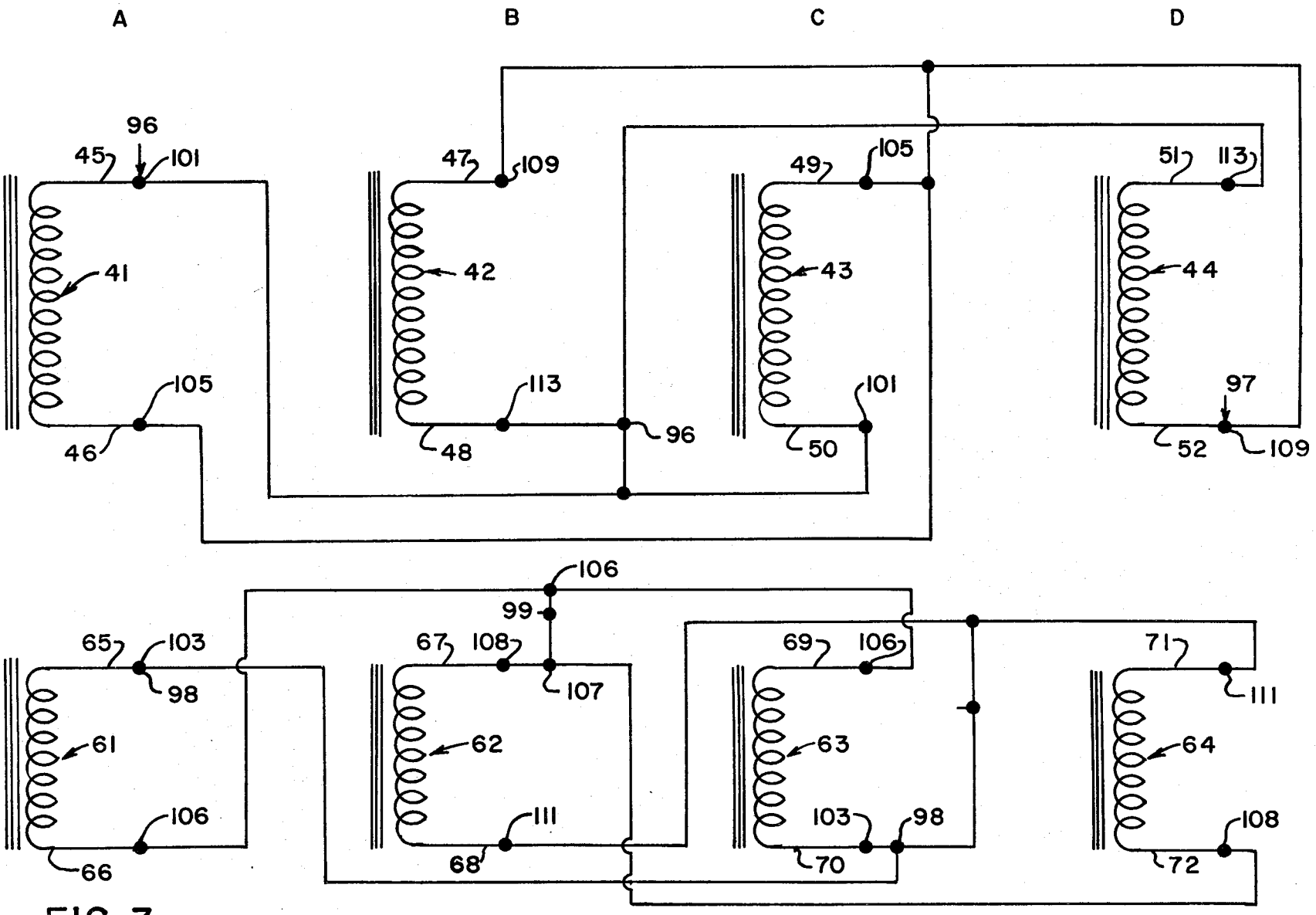
FIG. 3 is a wiring diagram of the primary and secondary coils.

Referring now to FIG. 3, it will be seen that the start 45 of primary coil 41 is connected to the end 48 of primary coil 42, the end 50 of the primary coil 43, and the start 51 of the primary coil 44. The end 46 of primary coil 41 is connected to the start 47 of primary coil 42, the start 49 of primary coil 43 and the end 52 of primary coil 44. The interconnections of the primary coils is thus complete, as shown in FIG. 3.

The start 65 of secondary coil 61 is connected to the end 68 of secondary coil 62, the end 70 of secondary coil 63 and the start 71 of the secondary coil 64. The end 66 of secondary coil 61 is connected to the start 67 of secondary coil 62, the start 69 of the secondary coil 63, and the end 72 of the secondary coil 64. The interconnections of the secondary coils is thus complete, as is apparent from FIG. 3.

Figure 4:
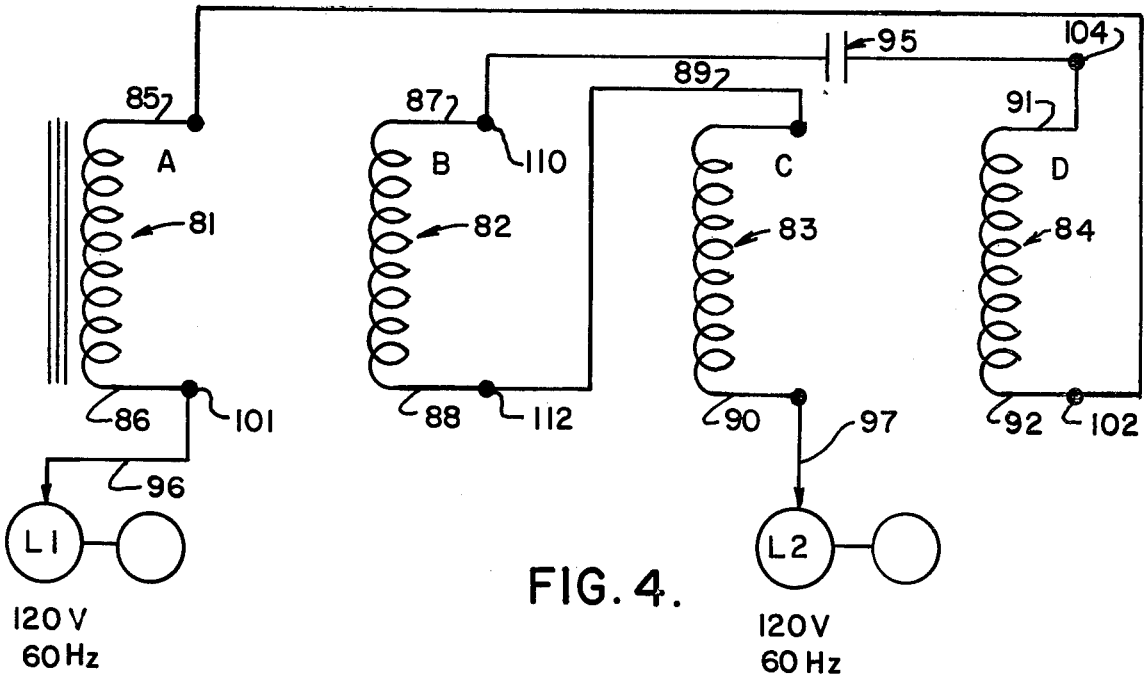
FIG. 4 is a wiring diagram of the capacitor coils.
Figure 5:
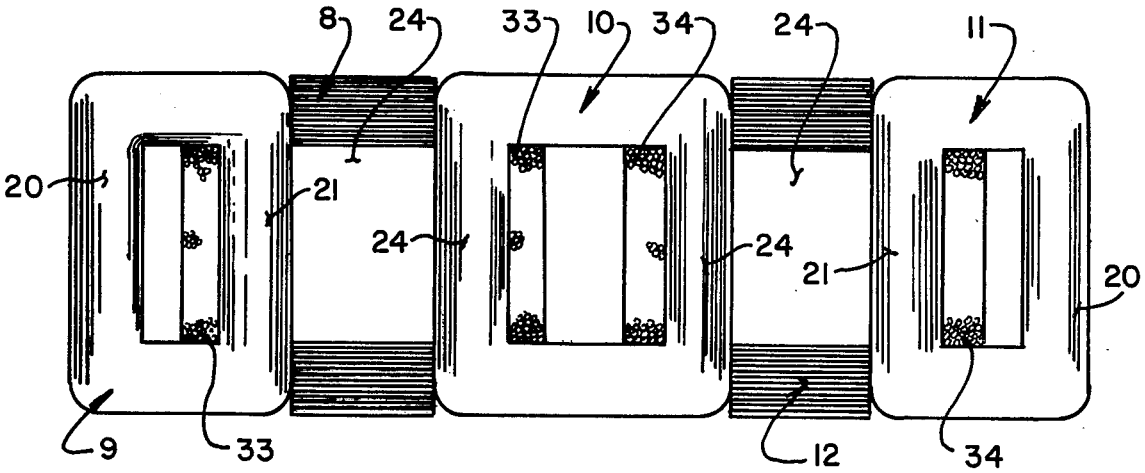
FIG. 5 is a sectional view taken along the line 5—5 of FIG. 2.

Referring now to FIG. 4, the end 86 of capacitor coil 81 is connected to line 96. The start 85 of capacitor coil 81 is connected to end 92 of capacitor coil 84. The start of capacitor coil 84 is connected to one side of a capacitor 95, the other side of which is connected to the start 87 of capacitor coil 82. The end 88 of capacitor coil 82 is connected to the start 89 of capacitor coil 83, and the end 90 of capacitor coil 83 is connected to line 97. The capacitor coils are thus connected in series, from 81 to 84, from 84, by way of the capacitor 95, to 82 thence to 83, i.e., from A to D to B to C. The capacitor 95 is connected in series between D and B, i.e. between the second and fourth coils, reckoning from A through D consecutively.

The primary and secondary coils are parallel connected to adjacent coil assemblies 180° out of phase, and to the diagonal coil assembly in phase. The capacitor coils are series connected to one another so each capacitor coil voltage is added to each other capacitor coil. Two of the ends of each bank of two series connected capacitor coils are in turn connected to the capacitor, which will have a high voltage potential which is the sum of all capacitor coils in series plus the line voltage.

The 180° out of phase parallel connections of the four primary coils will produce a north and south pole on each of the four coil assemblies and this polarity will reverse each half cycle of the line voltage, thus making this transformer more or less an eight magnetic pole transformer, which reverses polarity each half cycle of said line voltage.

Terminal 101 is connected to primary coils 45 and 50 and capacitor coil 86. Terminal 102 is connected to capacitor coils 85 and 92. Terminal 103 is connected to the output 98 and to secondary coils 65 and 70. Terminal 104 is connected to capacitor coil 91. Terminal 105 is connected to the input 97 (e.g. a source of 120V 60 Hz AC), and to primary coils 46 and 49 and capacitor coil 90. Terminal 106 is connected to output 99 and to secondary coils 66 and 69. Terminal 107 is connected to terminals 107 and 108, and serves as the tap to the load. Terminal 108 is connected to the output 99 and to secondary coils 67 and 72. Terminal 109 is connected to input 97 and to primary coils 47 and 52. Terminal 110 is connected to capacitor coil 87. Terminal 111 is connected to output 98 and secondary coils 68 and 71. Terminal 112 is connected to capacitor coils 88 and 89, and terminal 113 is connected to input 96 and primary coils 48 and 51.

Merely by way of example, using twelve 5 $cm^2$ solid laminated cores (Hipersil), with window widths in the outside cores of ⅝" and in the connecting cores of 1 5/16", for a core area in each sector of 20 $cm^2$, primary coils of 150 turns of 17 AWG wire each, secondary coils of 18 turns of flat 9 AWG wire, and capacitor coils of 50 turns of 21 AWG wire each, and a 4 mfd 600 volt paper capacitor, line voltage of 120 volts at 60 Hz, the secondary output was 14.4 volts open, and 14.27 volts loaded with a 55 amp load. At a 125 amp load, the primary voltage was 118.3 volts, the secondary 14.0 volts open and 13.49 volts loaded. The capacity of the transformer is in the neighborhood of 1900 watts.

Numerous variations in the construction of the transformer of this invention, within the scope of the appended claims, will occur to those skilled in the art in the light of the foregoing disclosure. The capacitor coils and capacitor can be eliminated, and the transformer will give excellent performance, but not as excellent as the transformer with the capacitor coils and capacitor. The dimensions of the cores, the numbers of turns and sizes of the wire of the coils, the arrangement of the terminals can all be varied. These are merely illustrative.

I claim:

1. A transformer comprising twelve cores, a first six arranged in parallel rows of three, a second six, in parallel rows of three at right angles to the first six and positioned between the first and second, and second and third cores of each of the two parallel rows of the said first six cores, four coil assemblies each comprising a primary winding and a secondary winding, each of said primary and secondary windings embracing legs of four cores, said primary and secondary windings being electrically connected in parallel to like windings in adjacent coil assemblies in a 180° out of phase connection.

2. The transformer of claim 1 wherein each of said coil assemblies includes a capacitor coil, and said capacitor coils are series connected to capacitor coils in diagonal assemblies so that each capacitor coil voltage is added to each other capacitor coil, the first and fourth of said capacitor coils being electrically connected to different sides of the line voltage, and the second and third of said capacitor coils being electrically connected in series to a capacitor.

* * * * *